US006445893B2

(12) United States Patent
Hashimoto et al.

(10) Patent No.: US 6,445,893 B2
(45) Date of Patent: Sep. 3, 2002

(54) METHOD OF REATTACHING A TONER SEAL

(75) Inventors: Koji Hashimoto, Shizuoka; Tatsuya Shiratori, Kanagawa; Kazuhiko Kanno, Kanagawa; Tachio Kawai, Kanagawa, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/887,115

(22) Filed: Jun. 25, 2001

(30) Foreign Application Priority Data

Jun. 26, 2000 (JP) ..... 2000-190848

(51) Int. Cl.[7] ..... G03G 15/08
(52) U.S. Cl. ..... 399/106; 399/109
(58) Field of Search ..... 399/102, 103, 399/106, 110, 111, 119, 262, 109; 222/DIG. 1

(56) References Cited

U.S. PATENT DOCUMENTS 5,260,749 A * 11/1993 Yahata ..... 399/106
5,802,441 A * 9/1998 Okada ..... 399/262
6,002,898 A 12/1999 Yokomori et al. ..... 399/119
6,058,278 A * 5/2000 Tsuda et al. ..... 399/106
6,064,844 A 5/2000 Isobe et al. ..... 399/119
6,070,027 A 5/2000 Kawai et al. ..... 399/103
6,122,458 A * 9/2000 Kita et al. ..... 399/106 X
6,181,897 B1 1/2001 Kawai ..... 399/103

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

A method of reattaching a toner seal to a toner frame having a developer containing portion for containing a developer therein, a developer supplying opening for supplying the developer therethrough from the developer containing portion, in order to seal the developer supplying opening, which method includes (a) the detaching step of detaching the already taken-up toner seal from a take-up spool for taking up the toner seal, (b) the sticking step of sticking the toner seal on the toner frame so as to seal the developer supplying opening, (c) the folding-back step of folding back the toner seal from the end portion of the stuck portion of the toner seal, and (d) the attaching step of attaching the free end portion of the folded-back toner seal to the take-up spool for taking up the toner seal to unseal the developer supplying opening so that the operation of a detecting lever for detecting that a predetermined amount of the toner seal has been taken up to unseal the developer supplying opening may be restricted by the toner seal.

9 Claims, 9 Drawing Sheets

25
26b
26c
25a
26
9h
9c
9YS(9MS, 9CS, 9BS)
9c
9g
26a
26d
27a
28
28a
27

METHOD OF REATTACHING A TONER SEAL

BACKGROUND OF THE INVENTION

1. Field of the Invention

This invention relates to a method of reattaching a toner seal for sealing a developer supplying opening for supplying a developer from a developer containing portion.

2. Related Background Art

In image forming apparatuses using the electrophotographic image forming process, there has heretofore been adopted a process cartridge system in which an electrophotographic photosensitive member and process means acting on the electrophotographic photosensitive member are integrally made into a cartridge which is detachably mountable on the main body of the image forming apparatus. According to this process cartridge system, the maintenance of the apparatus can be done by a user himself without resorting to a serviceman and therefore, operability could be improved markedly. So, this process cartridge system is widely used in the image forming apparatuses.

In such a process cartridge, provision is made of a photosensitive drum, and developing means is used to impart a developer (toner) to a latent image formed on the photosensitive drum. This developing means comprises a developing frame holding a developing roller or the like for feeding the toner to the photosensitive drum, and a toner frame containing the toner therein and connected to the developing frame. Before use, an opening portion provided in the connecting portion between the toner frame and the developing frame is sealed by a seal member. There is conceived an image forming apparatus in which a process cartridge provided with a seal automatic unsealing device for automatically unsealing the seal member sealing the opening portion of the toner frame when the process cartridge is mounted on the main body of the image forming apparatus in case of the first use and the seal automatic take-up device of the process cartridge can be driven.

The process cartridge refers to charging means or cleaning means and developing means and an electrophotographic photosensitive drum integrally made into a cartridge which is made detachably mountable to the main body of an image forming apparatus. It also refers to at least one of charging means and cleaning means and developing means and an electrophotographic photosensitive drum integrally made into a cartridge which is made detachably mountable to the main body of the image forming apparatus. It further refers to at least developing means and an electrophotographic photosensitive drum integrally made into a cartridge which is made detachably mountable to the main body of the apparatus.

However, in a developer containing portion provided with the aforedescribed toner seal automatic unsealing device, no consideration has been given to easily reattaching the toner seal.

So, the present invention solves the above-noted problem.

SUMMARY OF THE INVENTION

It is an object of the present invention to provide a method of reattaching a toner seal.

It is another object of the present invention to provide a toner seal reattaching method capable of easily reattaching a toner seal.

It is another object of the present invention to provide a toner seal reattaching method capable of easily effecting the refilling of a developer containing portion provided with a toner seal automatic unsealing device with a developer.

It is another object of the present invention to provide a method of reattaching a toner seal to a toner frame having a developer containing portion for containing a developer therein and a developer supplying opening for supplying the developer therethrough from the developer containing portion, in order to seal the developer supplying opening, comprising;

(a) the detaching step of detaching the already taken-up toner seal from a take-up spool for taking up the toner seal;

(b) the sticking step of sticking the toner seal on the toner frame so as to seal the developer supplying opening;

(c) the folding-back step of folding back the toner seal from the stuck end portion thereof; and (d) the attaching step of attaching the leading end portion of the folded-back toner seal to the take-up spool for taking up the toner seal to unseal the developer supplying opening in the state of restricting by the toner seal the operation of a detecting lever for detecting that a predetermined amount of the toner seal has been taken up to unseal the developer supplying opening.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Figure 1:
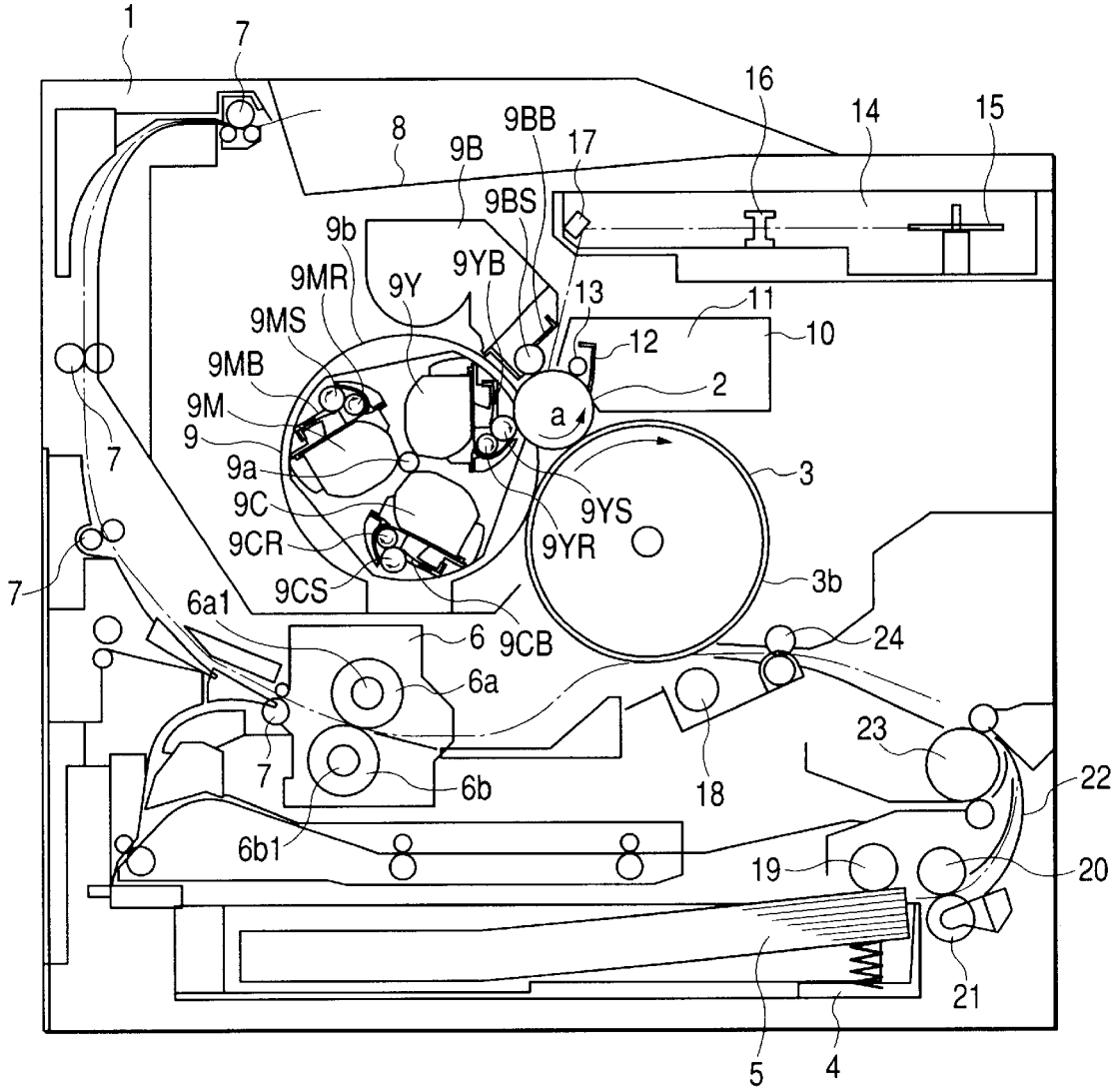
FIG. 1 is a longitudinal cross-sectional view showing the construction of an image forming apparatus using a toner container according to an embodiment of the present invention.
Figure 2:
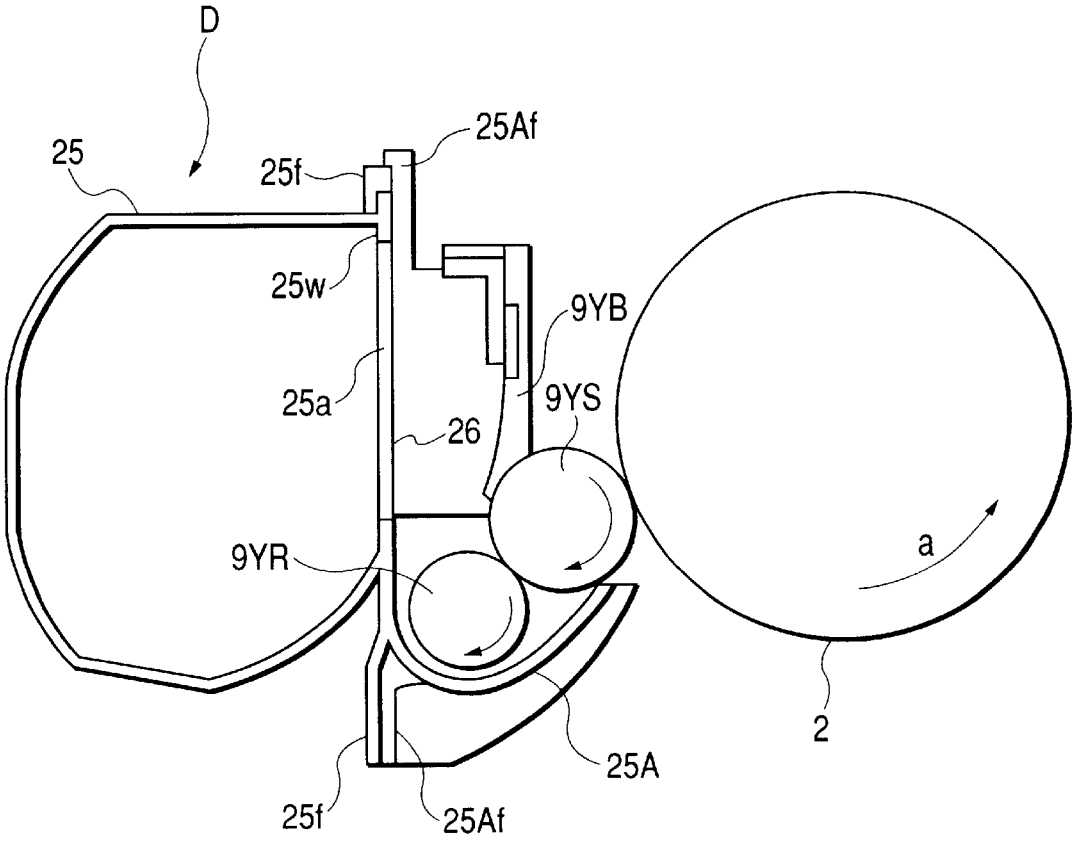
FIG. 2 is a vertical cross-sectional view of a developing device.
Figure 3:
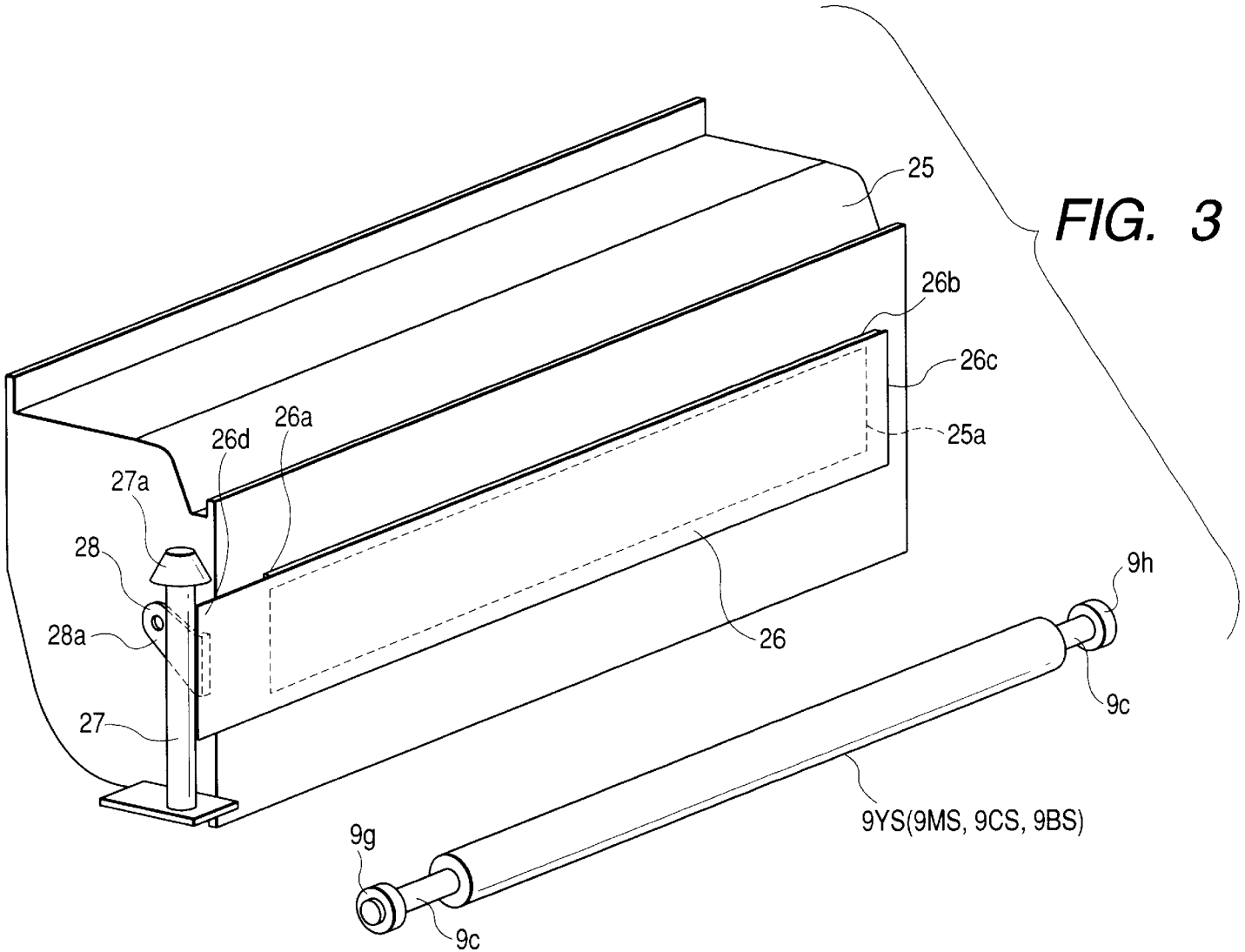
FIG. 3 is a perspective view showing a state in which a toner seal is attached to the toner container according to the embodiment of the present invention.

An embodiment in which the present invention is applied to a developing cartridge according to the present invention and a color laser beam printer as an example of an image forming apparatus using the same will hereinafter be specifically described with reference to the drawings. FIG. 1 is a cross-sectional view showing the construction of the image forming apparatus using the developing cartridge according to the present invention, and FIGS. 2 and 3 are a vertical cross-sectional view of the developing cartridge according to the present invention and a perspective view showing the construction of a developer container, respectively.

Reference is first had to FIG. 1 to describe the general construction of the image forming apparatus according to the present invention. In FIG. 1, the image forming apparatus transfers toner images formed on the surface of a photosensitive drum 2 which is image forming means comprised of an electrophotographic photosensitive member rotated at a predetermined speed to an intermediate transfer member 3 a predetermined number of times, thereafter collectively transfers the toner images on the intermediate transfer member 3 to a transfer material 5 fed from a cassette 4 which is a feed portion, and transports the transfer material to a fixing device 6, whereafter the transfer material is delivered to a delivery portion 8 in the upper portion of the main body 1 of the image forming apparatus by delivery rollers 7.

Also, an image forming portion 9 comprising a black developing device 9B fixed relative to the main body 1 of the image forming apparatus, and rotatable color developing devices 9Y, 9M and 9C of three colors (yellow, magenta and cyan) is provided in proximity to the photosensitive drum 2, and latent images formed on the photosensitive drum 2 are developed by the image forming portion 9, and the developed images are multilayer-transferred onto the intermediate transfer member 3, whereby a color image is formed.

The rotatable color developing devices 9Y, 9M, 9C and the stationary black developing device 9B which are an example of a developing cartridge are discretely detachably mountable to the main body 1 of the apparatus.

A process cartridge 10 is constructed integrally with the photosensitive drum 2 and a cleaning container 11 serving also as a holder for the photosensitive drum 2 and for collecting the residuals on the surface of the photosensitive drum 2. This process cartridge 10 is detachably supported relative to the main body 1 of the apparatus, and is designed to be easily interchangeable in accordance with the service life of the photosensitive drum 2.

The photosensitive drum 2 in the present embodiment is comprised of a cylinder having a diameter of about 62 mm and formed of aluminum, and an organic photoconductor layer applied to the outer side of the cylinder, and is supported for rotation relative to the cleaning container 11 serving also as the holder for the photosensitive drum 2. Near the outer periphery of the photosensitive drum 2, there are disposed a cleaning blade 12 which is cleaning means for removing the residuals on the surface of the photosensitive drum 2, and primary charging means 13 for charging the surface of the photosensitive drum 2.

Also, the photosensitive drum 2 is rotated in the direction indicated by the arrow "a" in FIG. 1 correspondingly to the image forming operation by the driving force of a drive motor, not shown, being transmitted to one end thereof on the back side of the plane of the drawing sheet of FIG. 1.

The primary charging means 13 uses the contact charging method, and the primary charging means 13 which is an electrically conductive roller is brought into contact with the photosensitive drum 2 and a voltage is applied to the primary charging means 13 to thereby uniformly charge the surface of the photosensitive drum 2.

The exposure of the photosensitive drum 2 is effected from a scanner portion 14 disposed in the upper portion of the main body 1 of the apparatus. That is, when an image signal is given to a laser diode, this laser diode applies image light corresponding to the image signal to a polygon mirror 15.

This polygon mirror 15 is rotated at a high speed by a scanner motor, and the surface of the photosensitive drum 2 being rotated at a predetermined speed is selectively exposed to the image light reflected by the polygon mirror 15 through the intermediary of an imaging lens 16 and a reflecting mirror 17, and as the result, an electrostatic latent image is formed on the surface of the photosensitive drum 2.

The image forming portion 9 for visualizing the electrostatic latent image, as previously described, is comprised of three color developing devices 9Y, 9M, 9C and a black developing device 9B enabling the color development in yellow, magenta, cyan and black.

The black developing device 9B is a stationary developing device, and a sleeve 9BS which is a developing rotary member for supplying the photosensitive drum 2 with a black toner which is a developer is disposed at a position opposed to the photosensitive drum 2 with a minute spacing (of the order of 300 $\mu$m) relative to the photosensitive drum 2, and forms a visible image by the black toner correspondingly to the electrostatic latent image on the photosensitive drum 2.

On the other hand, each of the three color developing devices 9Y, 9M, 9C contains therein a toner corresponding to 7,000 pages (A4 size, 5% coverage rate) and is detachably supported by a developing rotary 9*b* rotated about a shaft 9*a*.

In case of image formation, the respective color developing devices 9Y, 9M, 9C are rotatively moved about the shaft 9*a* while being supported by the developing rotary 9*b*, and predetermined one of the color developing devices 9Y, 9M, 9C is stopped at a position opposed to the photosensitive drum 2, and sleeves 9YS, 9MS and 9CS which are developing rotary members for supplying the photosensitive drum 2 with yellow, magenta and cyan toners which are developers are positioned so as to be opposed to the photosensitive drum 2 with a minute spacing (of the order of 300 $\mu$m) relative to the photosensitive drum 2, whereafter visible images by the color toners are formed correspondingly to the electrostatic latent image on the photosensitive drum 2.

During color image formation, the developing rotary 9*b* is rotated for each one full revolution of the intermediate transfer member 3, and the developing step is executed in the order of the yellow developing device 9Y, the magenta developing device 9M, the cyan developing device 9C and the black developing device 9B.

In FIG. 1, there is shown a state in which the yellow developing 9Y is positioned in opposed relationship with the photosensitive drum 2 and is at rest. The yellow developing device 9Y feeds the developer to a supplying roller 9YR which is a supplying rotary member for supplying the developer to the surface of the sleeve 9YS, by a toner feeding mechanism in a developing container for containing the developer therein, and applies a thin layer of toner to the surface of the sleeve 9YS rotated clockwisely in FIG. 1, by a developing blade 9YB brought into pressure contact with the outer peripheries of the supplying roller 9YR and sleeve 9YS rotated clockwisely in FIG. 1, and induces charges (triboelectrification) in the toner. A developing bias is then applied to the sleeve 9YS opposed to the photosensitive drum 2 on which the latent image is formed to thereby effect toner development on the photosensitive drum 2 in conformity with the latent image.

With regard also to the magenta developing device 9M and the cyan developing device 9C, supplying rollers 9MR, 9CR which are supplying rotary members and sleeves 9MS, 9CS which are developing rotary members and developing blades 9MB, 9CB act by a mechanism similar to that described above and the toner developing steps are executed.

Also, the respective sleeves 9YS, 9MS, 9CS of the rotatable developing devices 9Y, 9M, 9C are connected to high voltage sources and driving means for respective color development provided in the main body 1 of the apparatus when the respective developing devices 9Y, 9M, 9C are rotatively driven to the developing position, and a voltage is sequentially and selectively applied during each color development and rotative driving is effected.

During the color image forming operation, the intermediate transfer member 3 receives the multilayer transfer of the toner images on the photosensitive drum 2 visualized by the respective developing devices 9Y, 9M, 9C, 9B four times (images of the four colors yellow, magenta, cyan and black) and therefore, it is rotated clockwisely in FIG. 1 in synchronism with the outer peripheral speed of the photosensitive drum 2, and the intermediate transfer member 3 which has received the multilayer transfer transports the transfer material 5 by nipping the latter between itself and the transfer roller 18 having a voltage applied thereto, whereby the color toner images on the intermediate transfer member 3 are multilayer transferred to the transfer material 5 at a time.

In the present embodiment, the intermediate transfer member 3 comprises of a cylinder 3*a* made of aluminum having a diameter of 186 mm of which an outer peripheral is coated with an elastic layer 3*b* such as a medium-resistance sponge and a medium-resistance rubber. The intermediate transfer member 3 is supported to be rotated by a gear (not shown) integrally fixed thereto receiving a drive force.

The cleaning means for the photosensitive drum 2 is for removing any toners remaining on the photosensitive drum 2 after the toner images visualized on the photosensitive drum 2 by the developing devices 9Y, 9M, 9C, 9B are transferred to the intermediate transfer member 3, and the removed toners are stored in the cleaning container 11. The amount of the removed toners stored in the cleaning container 11 does not fill the cleaning container 11 earlier than the service life of the photosensitive drum 2 and accordingly, the cleaning container 11 is interchanged simultaneously with the interchange of the photosensitive drum 2 at the end of its service life.

The feed portion is for feeding the transfer material 5 to the image forming portion 9, and is comprised of a cassette 4 containing a plurality of transfer materials 5 therein, and transporting means such as a pickup roller 19, a feed roller 20, a double feed preventing retard roller 21, a feed guide 22, a transport roller 23 and a registration roller 24.

During image formation, the pickup roller 19 is rotatively driven in conformity with the image forming operation and picks up the transfer materials 5 in the cassette 4, and the transfer materials are then separated and fed one by one by the cooperative action of the feed roller 20 and the retard roller 21, and are guided by the feed guide 22 and come to the registration roller 24 via the transport roller 23. During the image forming operation, the registration roller 24 performs the non-rotating operation of causing the transfer material 5 to come to a halt and stand by and the rotating operation of transporting the transfer material 5 toward the intermediate transfer member 3 at a predetermined sequence, and effects the registration between the image and the transfer material 5 during the transferring step which is the next step.

The transfer portion comprises a rockable transfer roller 18, which in turn comprises a metal shaft and a medium-resistance foamed elastic material wound around the outer periphery thereof, and is movable in a vertical direction in FIG. 1 and is rotatively driven.

During the time when toner images of the four colors are being formed on the intermediate transfer member 3, i.e., during the time when the intermediate transfer member 3 is rotated a plurality of times, the transfer roller 18 is downwardly retracted and spaced apart from the intermediate transfer member 3 so as not to disturb those images, and after the toner images of the four colors are formed on the intermediate transfer member 3, the transfer roller 18 is urged against the intermediate transfer member 3 with predetermined pressure by a cam member, not shown, with the transfer material 5 interposed therebetween in timed relationship with the transfer of the color images to the transfer material 5. At this time, a bias is applied to the transfer roller 18 and the toner images formed on the intermediate transfer member 3 are transferred to the transfer material 5.

The intermediate transfer member 3 and the transfer roller 18 are driven independently of each other and therefore, the transfer material 5 nipped between the two is transported leftwardly as viewed in FIG. 1 at a predetermined speed simultaneously with the transferring step being executed, and is sent to the fixing device 6 which is the next step.

The fixing device 6 is for fixing the toner images formed by the developing devices 9Y, 9M, 9C, 9B and transferred onto the transfer material 5 through the intermediate transfer member 3, and comprises a fixing roller 6*a* for applying heat to the transfer material 5, and a pressure roller 6*b* for urging the transfer material 5 against the fixing roller, and the rollers 6*a* and 6*b* are hollow rollers having heaters 6*a*1 and 6*b*1, respectively, therein, and the transfer material 5 is nipped between and transported by the fixing roller 6*a* and the pressure roller 6*b* and has heat and pressure applied thereto, whereby the toner images are fixed on the transfer material 5.

The construction of the toner container using the present invention and the toner seal reattaching step will now be described in detail with reference to FIGS. 2 to 6.

FIG. 3 is a perspective view showing a state in which a toner seal is attached to the toner container according to the present invention.

The frame of the developing devices 9Y, 9M, 9C, 9B, as shown in FIG. 2, has the toner container 25 containing the toners therein and a developing frame 25A supporting the developing sleeves 9YS, 9MS, 9CS, 9BS, the developing blades 9YB, 9MB, 9CB, 9BB and the toner supplying rollers 9YR, 9MR, 9CR, 9BR, the toner container 25 and the developing frame 25A being connected together.

In FIG. 3, the reference numeral 25 designates a toner container, and the reference character 25*a* denotes an opening in the toner container for supplying the toner therethrough. A toner seal 26 for sealing the opening 25*a* is attached to the opening 25*a* portion of the toner container 25 from the area 26*a* of one end thereof to the area 26*b* of the other end thereof in the lengthwise direction of the opening 25*a* (a direction parallel to the developing sleeve) as by the hot welding method in such a manner as to completely close the opening 25*a* portion of the toner container 25. After having been attached, the toner seal 26 is folded back at a fold-back portion 26c, and is put upon the portion thereof attached to the marginal edge of the opening 25*a*. The end portion 26*d* of the toner seal is attached to a toner seal take-up spool 27 as by glueing or clasping. The take-up spool 27 is orthogonal to the lengthwise direction of the toner seal 26, and is rotatably supported by the toner container 25. A detecting lever 28 for detecting that the toner seal 26 has been completely pulled is in a position 28*a* in which it is detecting that the toner seal 26 is not being pulled. In this state, drive is transmitted to the take-up spool 27 by a driving mechanism, not shown, whereby the take-up spool 27 is rotated and takes up the toner seal 26.

Figure 6:
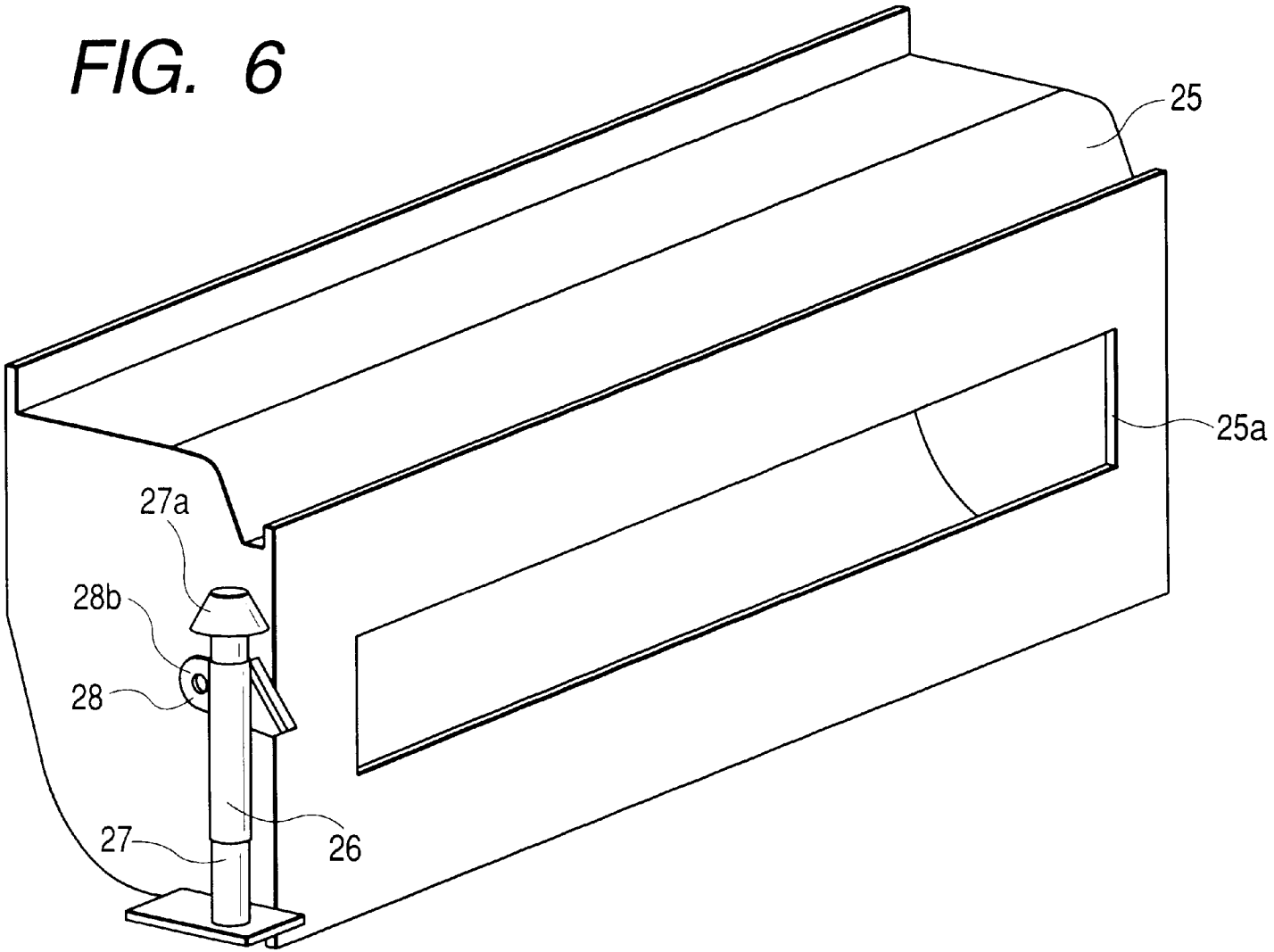
FIG. 6 is a perspective view showing a state in which the toner seal has been completely taken up.

FIG. 6 is a perspective view showing a state in which the toner seal has been completely taken up.

As shown in FIG. 2, the toner container 25 has the toner supplying opening 25*a* in a wall portion 25*w*. The opening 25*a* is sealed by the toner seal 26 which will be described later. The toner container 25 and a developing frame 25A have their respective flanges 25*f* and 25Af ultrasonically welded thereto. Or the flanges 25Af and 25*f* are made to abut against each other with a sealing packing interposed therebetween and are detachably fastened to each other.

The developing sleeve 9YS, the toner supplying roller 9YR and the developing blade 9YB are mounted on the developing frame 25A.

The foregoing description made of the developing device 9Y also applies to the constructions of the developing devices 9M and 9C.

The black developing device 9B is independently mounted and dismounted with respect to the main body of the printer, and differs in shape from the color developing devices 9Y, 9M, 9C, but is similar in construction to the color developing devices 9Y, 9M, 9C with the exception that it has no toner supplying roller, and likewise has a toner seal 26 for sealing the opening 25*a* in the toner container 25.

The construction of an example of a toner seal automatic unsealing mechanism will now be described in detail with reference to FIGS. 3 to 6.

Figure 4:
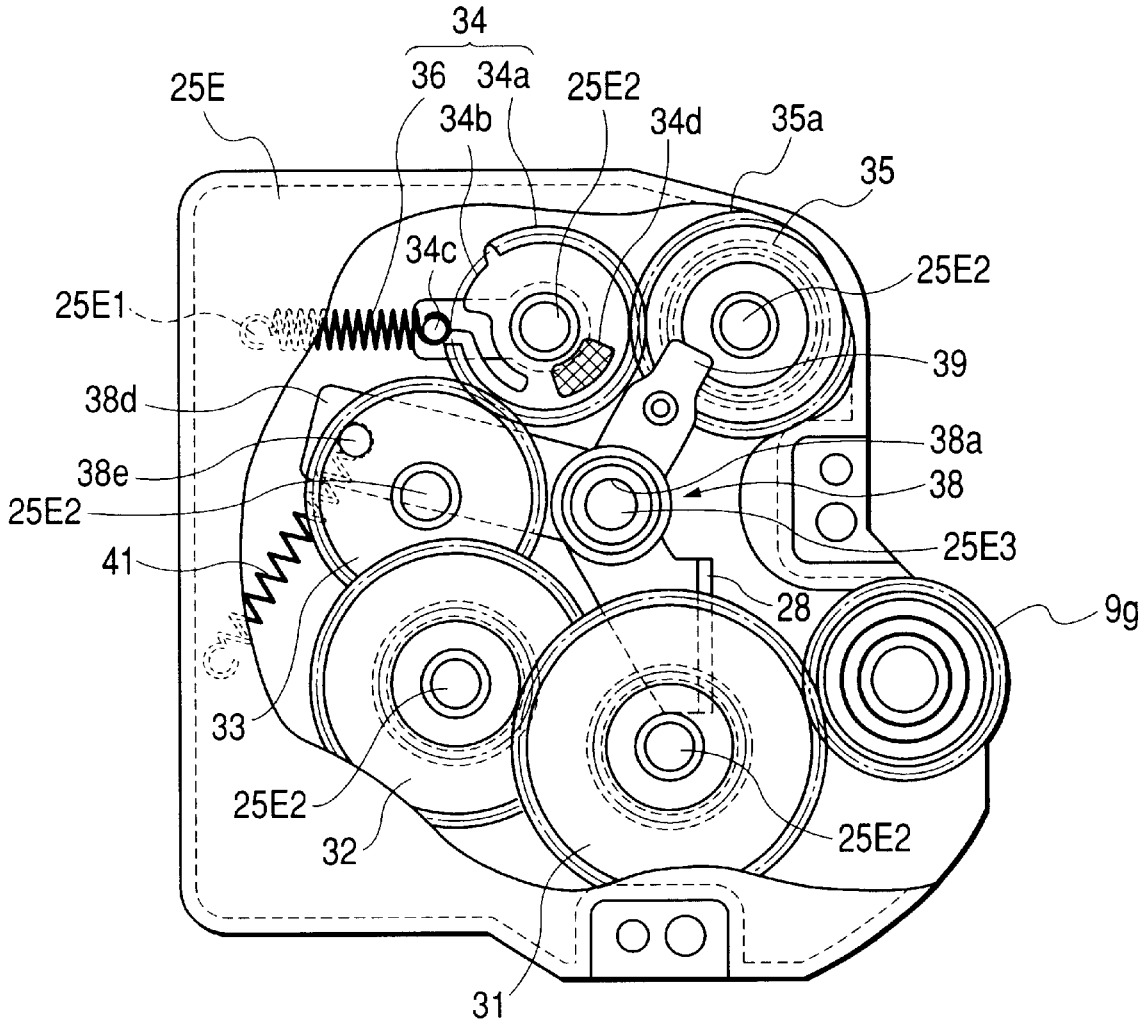
FIG. 4 is a side view of a toner seal automatic unsealing mechanism.
Figure 5:
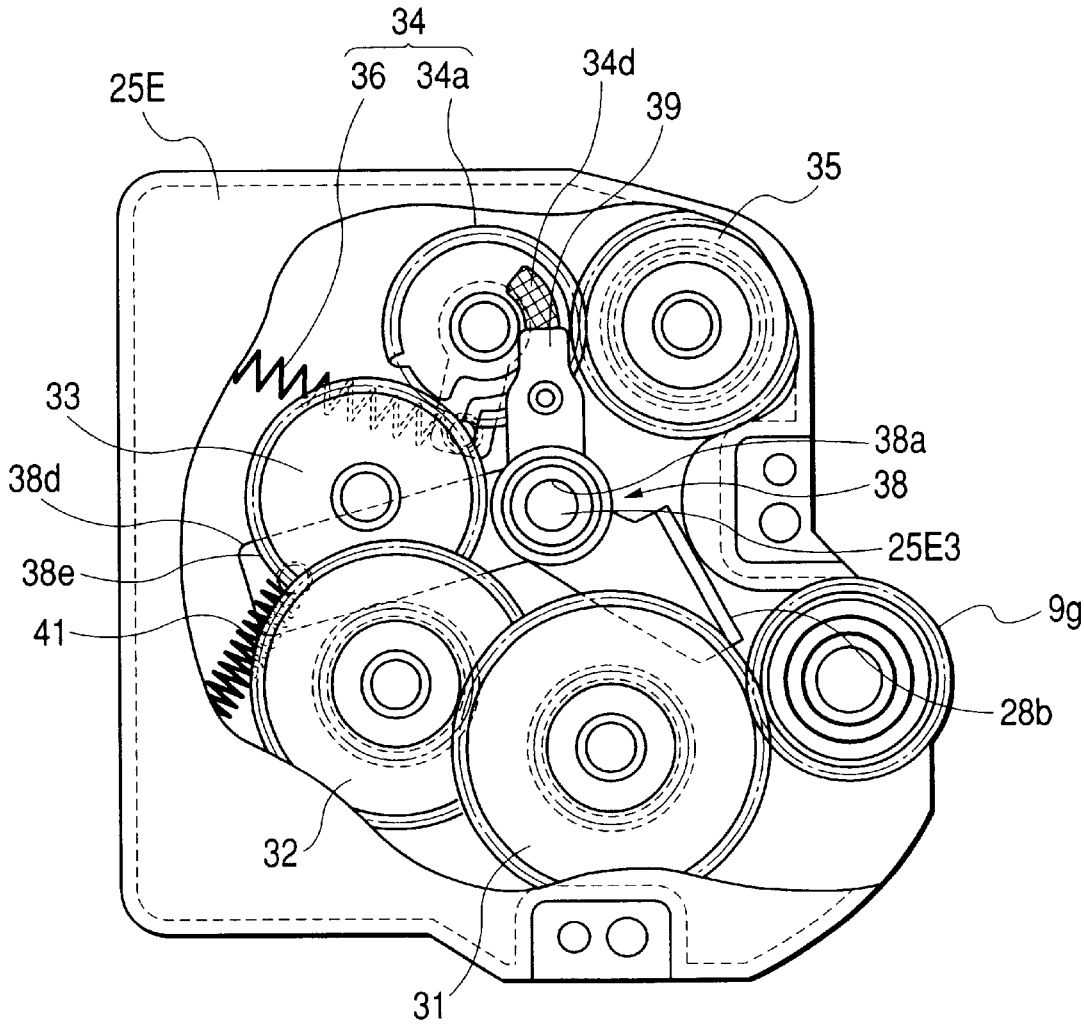
FIG. 5 is a side view of the toner seal automatic unsealing mechanism.

FIG. 4 shows the state before the toner seal 26 is taken up, and FIG. 5 shows the state after the toner seal 26 has been taken up. A side holder 25E is fixed to the lengthwise end portion of the toner container 25. Idler gears 31, 32, 33, a partly toothless gear 34*a* and a second bevel gear 35 are rotatably supported on a plurality of dowels 25E2 provided on the side holder 25E. An idler gear 31 first meshing with a developing sleeve gear 9*g* is rotatably supported on the side holder 25E. The developing sleeve gear 9*g* is fixed to one end of the developing sleeve 9YS coaxially therewith. Subsequently, an idler gear 32 and an,idler gear 33 for reducing the rotative drive from the developing sleeve gear 9*g* to a predetermined number of revolutions successively mesh with each other and are supported. Each of the idler gears 31 and 32 is a two-stage gear and the transmission of the rotation thereof is effected by the pinion (small gear) of the two-stage gear meshing with the gear wheel (large gear) of the partner two-stage gear. Further, the second bevel gear 35 meshing with a first bevel gear 27*a* formed integrally with the take-up spool 27 is in meshing engagement with the idler gear 33 through the partly toothless gear 34*a*, and by these gear trains, the driving force inputted from the main body of the printer (the main body of the image forming apparatus) is transmitted to the take-up spool 27. The second bevel gear 35 has a gear 35*a* integrally therewith. The gear 35*a* is a spur gear and is in meshing engagement with the partly toothless gear 34*a*.

A toothless clutch 34 is comprised of a partly toothless gear 34*a* having a toothless portion 34*b* lacking some of the teeth thereof (about ⅕ to 1/10 of the total teeth), and a spring 36 having one end thereof hooked onto a shaft 34*c* at the tip end of an arm formed integrally with the lengthwisely inner end surface of the partly toothless gear 34*a* to thereby give a rotational force to the partly toothless gear 34*a*. The other end of the spring 36 is hooked onto a spring hook 25E1 provided on the side holder 25E. The spring 36 is a tension coil spring. The meshing engagement between the idler gear 33 and the partly toothless gear 34*a* is once interrupted in the toothless portion 34*b* of the partly toothless gear 34*a* when the drive is inputted. At that time, the partly toothless gear 34*a* receives a rotational force from the spring 36 and therefore, the partly toothless gear 34*a* is rotated to a position in which it comes into meshing engagement with the idler gear 33 and accordingly, the two gears 33 and 34*a* again come into meshing engagement with each other. This series of interruption and meshing engagement are repetitively effected for each one full revolution of the partly toothless gear 34*a*, and in the state as shown in FIG. 4, before the toner seal 26 is taken up, the meshing engagement between the toothless clutch 34 and the idler gear 33 is continuously kept. Further, a projected portion 34*d* for releasing the meshing engagement between the toothless clutch 34 and the idler gear 33 is formed on the lengthwisely outer end surface of the partly toothless gear 34*a* integrally therewith.

Also, detecting means 38 for detecting the take-up of the toner seal 26 and a stopper 39 responsive thereto to release the drive transmission to the take-up spool 27 are provided on the side holder 25E. The detecting means 38 is held for rotation about an aperture 38*a* fitted on a shaft 25E3 provided on the side holder 25E, and a toner seal detecting lever 28 extending therefrom is designed to abut against the vicinity of the end portion 26*d* of the toner seal 26 (see FIG. 3), and this detecting lever 28 is biased toward the vicinity of the end portion 26*d* of the toner seal 26 by a spring 41. Further, a stopper 39 is formed on the detecting lever 28 integrally therewith, and is operated in operative association with the detecting lever 28 of the detecting means 38 detecting the completion of the take-up of the toner seal 26, and abuts against the projected portion 34d of the toothless clutch 34. The spring 41 has one end thereof engaged with a spring hook 38*e* provided on the tip end portion of an arm 38*d* provided integrally with the detecting means 38 and has the other end thereof engaged with the side holder 25E. The spring 41 is a tension coil spring.

Description will now be made of the specific operation of an automatic unsealing mechanism for the toner seal 26 in the above-described construction.

When as shown in FIG. 3, the toner seal 26 is not taken up, the detecting lever 28 of the detecting means 38 abuts against the end portion 26*d* of the folded-back portion of the toner seal 26 and the position thereof is restricted as shown in FIG. 4, and at this time, the stopper 39 is retracted from its abutting position against the projected portion 34*d* of the toothless clutch 34 and the spring 41 is in its pulled state.

When in this state, a developing cartridge (which refers to the developing devices 9Y, 9S, 9C) D is mounted on the main body 1 of the image forming apparatus, drive is inputted from a driving gear, not shown, in the main body 1 of the image forming apparatus to a driven input gear (not shown) provided on the opposite end surface of the take-up spool 27. This driven input gear is in meshing engagement with a developing sleeve gear 9*h* mounted on a flange 9*c* on the side opposite to the lengthwise one end of the developing sleeve 9YS (9MS, 9CS, 9BS) on which the take-up spool 27 is disposed, and rotatively drives the developing sleeve 9YS (9MS, 9CS, 9BS). Thereby, the drive is transmitted from the above-described developing sleeve gear 9*g* to the idler gear 31, the idler gear 32, the idler gear 33, the partly toothless gear 34*a*, the gear 35*a*, the second bevel gear 35 and the first bevel gear 27*a* by the gear train, and the take-up spool 27 is rotated.

Thus, the toner seal 26 is sequentially taken up onto the take-up spool 27 from the state shown in FIG. 3 wherein the opening 25*a* is sealed, and when it is completely taken up by the take-up spool 27, the opening 25*a* is opened and the toner is supplied to the developing sleeve 9YS (9MS, 9CS, 9BS).

Next, when as shown in FIG. 6, the toner seal 26 is completely taken up by the take-up spool 27, the detecting lever 28 of the detecting means 38 comes to be not restricted by the toner seal 26 and accordingly, is rotatively moved about the aperture 38*a* in the biasing direction of the spring 41 and detects the completion of the take-up of the toner seal 26. At this time, the stopper 39 is operated in operative association with the detection of the completion of the take-up (the rotative movement), and the tip end thereof is pivotally moved on the locus of the projected portion 34*d* and abuts against the projected portion 34*d* of the toothless clutch 34 and therefore, the drive transmission to the take-up spool 27 is released. When the stopper 39 abuts against the outer periphery of the projected portion 34*d*, the front face of the projected portion 34*d* in the direction of movement thereof abuts against the stopper 39 because the stopper 39 is in the locus of the projected portion 34*d* when next the projected portion 34*d* has come round.

The interruption of the driving of the toothless clutch 34 will now be described. After the detecting means 38 detects the completion of the take-up of the toner seal 26, the stopper 39 is moved to a position in which it can abuts against the projected portion 34*d* of the toothless clutch 34. In this state, the idler gear 33 and the partly toothless gear 34*a* are still in meshing engagement with each other and the projected portion 34*d* has not yet arrived at a position in which it abuts against the stopper 39, and the drive is not yet interrupted. Thereafter, when the toothless clutch 34 receives a driving force from the idler gear 33 and is rotated thereby, the toothless portion 34*b* of the partly toothless gear 34*a* arrives at a position for meshing with the idler gear 33, and the meshing engagement between the two gears is interrupted. At this time, the partly toothless gear 34*a* receives a clockwise rotational force from the spring 36 and therefore tries to again rotate to a position in which it meshes with the idler gear 33, but before that, the projected portion 34*d* abuts against the stopper 39 and therefore, the partly toothless gear 34*a* keeps a state in which the drive transmission is interrupted without the teeth thereof again meshing with the idler gear 33. When the drive to this partly toothless gear 34*a* is interrupted, the drive to the second bevel gear 35 and the first bevel gear 27*a* is also cut off and therefore, it never happens that the arrive is again applied to the take-up spool 27. Accordingly, more than necessary rotative drive is not applied to the take-up spool 27 after the take-up of the toner seal 26, and the scattering of the toner and the production of abnormal sounds or the like by the beating-on caused by the end portion of the toner seal 26 striking against the members on the peripheral surface of the toner container can be prevented and further, it becomes possible to mitigate the load of the drive motor in the main body 1 of the image forming apparatus after the take-up of the toner seal 26.

Referring to FIG. 6, the toner seal 26 is completely taken up by the toner seal take-up spool 27. Here, the toner seal take-up detecting lever 28 is in a position 28*b* in which it detects that the toner seal 26 is in its taken-up state. In this state, the driving force of a driving mechanism, not shown, is interrupted by the toner seal detecting lever 28 and the driving force is not transmitted to the toner seal take-up spool 27.

(Method of Reattaching the Toner Seal)

For the reattachment of the toner seal 26, the connection between the toner container 25 and the developing frame 25A shown in FIG. 2 is released. If this connection is the fastening by a faster, for example, a small screw, when the small screw is removed, the toner container 25 and the developing frame 25A are separated from each other, and the developing frame 25A is detached while supporting the developing sleeve 9YS (9MS, 9CS, 9BS), the developing blade 9YB (9MB, 9CB, 9BS) and the toner supplying roller 9YR (9MR, 9CR). When it is detached, the toner seal 26 is in a state as shown in FIG. 6 wherein it has been taken up onto the take-up shaft 27. The opening 25*a* in the toner container is opened.

If the toner container 25 and the developing frame 25A are ultrasonically welded together, the toner seal automatically take-up mechanism mounted on the toner container 25 is bodily detached with a side cover and the flange 25*f* portion of the toner container 25 is eliminated, or the developing sleeve, the developing blade and the toner supplying roller are detached from the developing frame 25A and the flange 25Af of the developing frame 25A is eliminated to thereby separate the two from each other. After the reattachment of the toner seal which will be described later, in this case, the toner container 25 and the developing frame 25A are welded together with a liner of the eliminated thickness interposed between the flanges 25*f* and 25Af.

Figure 7:
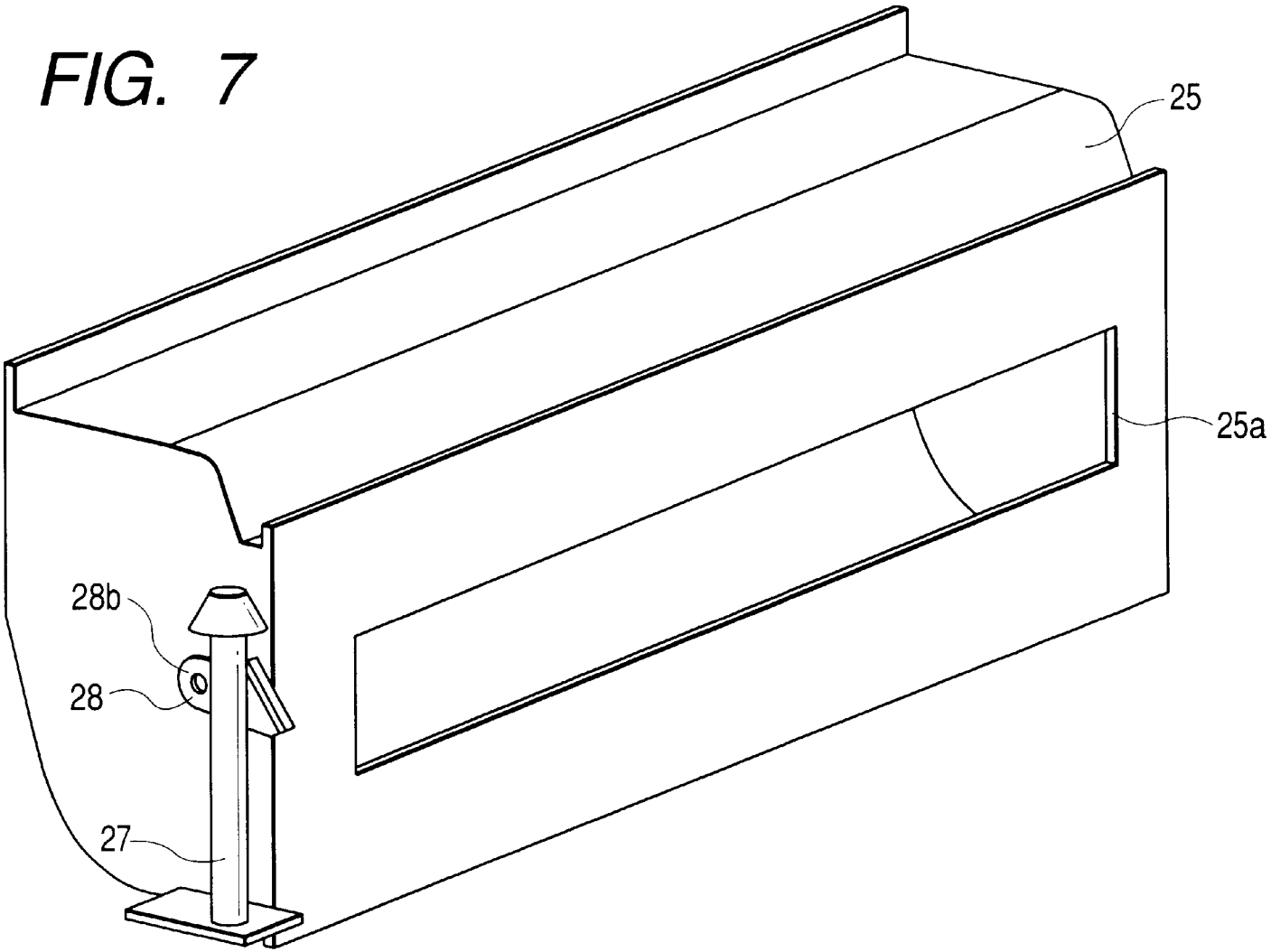
FIG. 7 is a perspective view showing a state in which the toner seal has been taken away from a take-up spool.

FIG. 7 is a perspective view showing a state in which the toner seal 26 shown in FIG. 6 has been taken away from the take-up spool 27.

The toner seal 26 which, in FIG. 6, has twined around the toner seal take-up spool 27 is taken away by the toner seal take-up spool 27 being rotated in a direction opposite to the direction in which the toner seal 26 is taken up. In this state, the toner seal take-up detecting lever 28 is in the position 28*b* in which it detects that the toner seal 26 is in its taken-up state.

Figure 8:
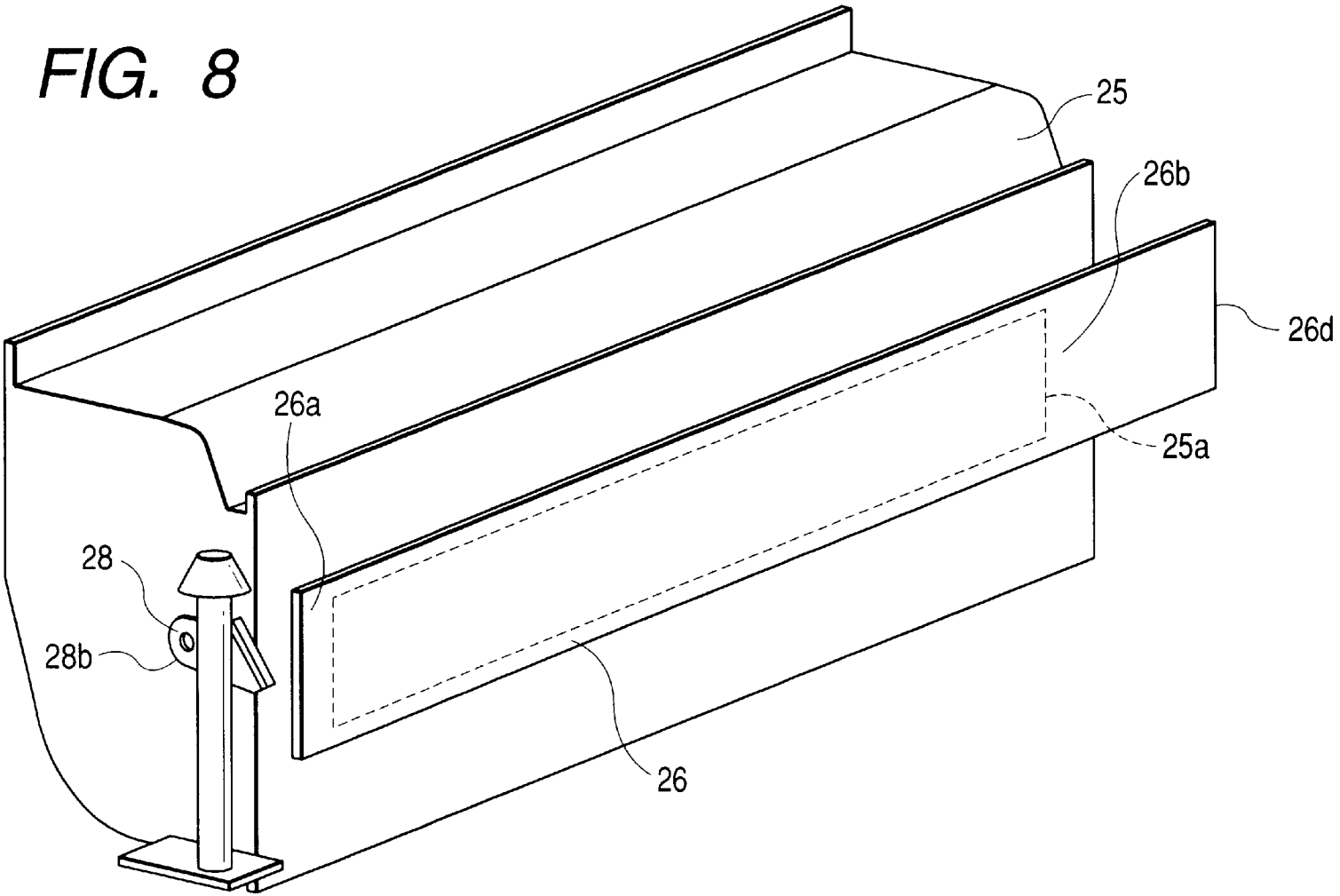
FIG. 8 is a perspective view showing a state in which the toner seal has been reattached.

FIG. 8 is a perspective view showing a state in which the toner seal has been reattached.

In FIG. 8, the toner seal 26 is welded to the toner container 25 from the area 26*a* to the area 26*b* by the use of the heat welding method or the like, and is in a state in which it completely closes the opening 25*a* in the toner container. In this state, the end portion 26*d* of the toner seal 26 is in a free state. Again here, the toner seal take-up detecting lever 28 is in the position 28*b* in which it detects that the toner seal 26 is in its taken-up state.

Figure 9:
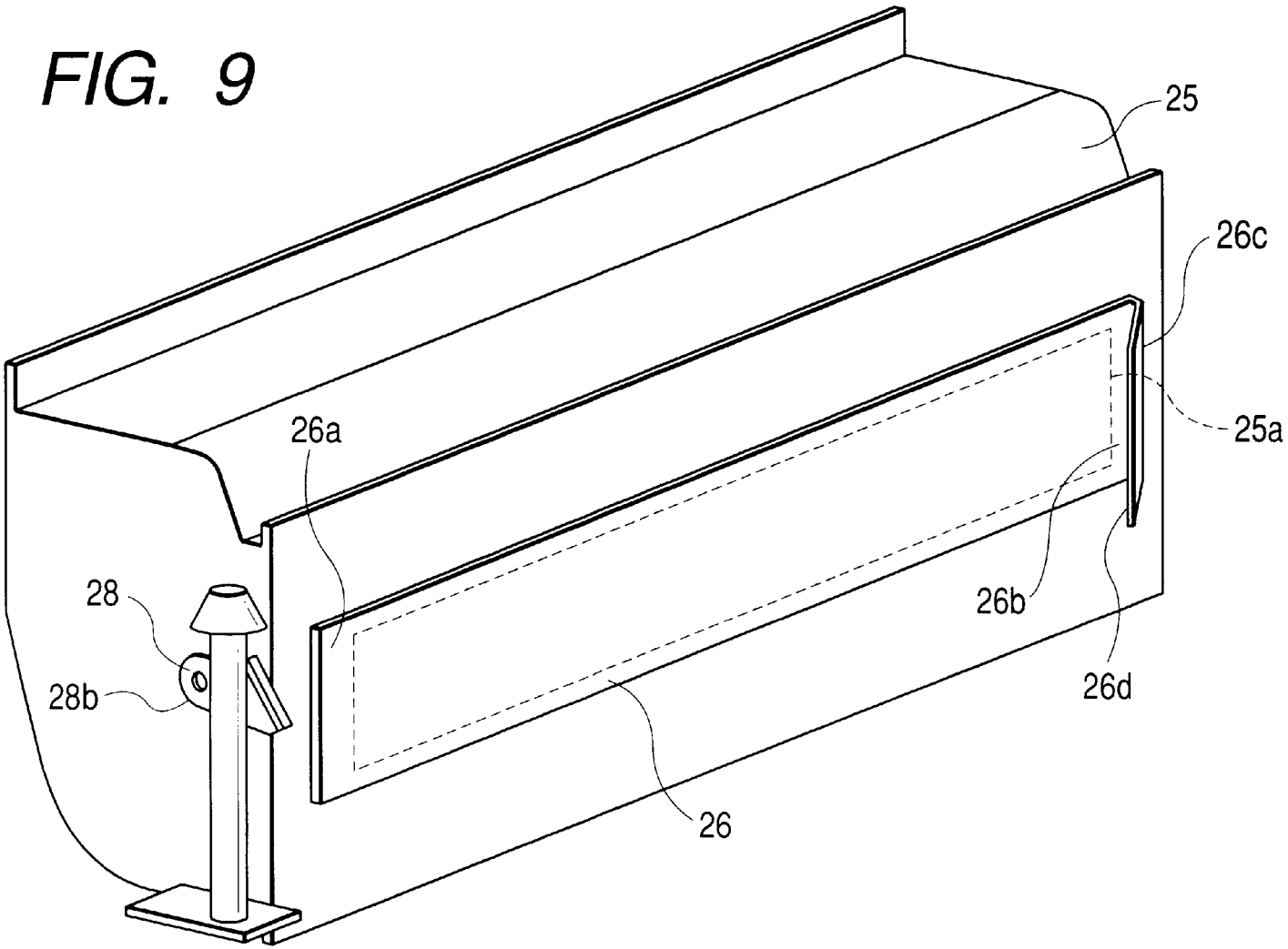
FIG. 9 is a perspective view showing a state in which the reattached toner seal has been folded back.

FIG. 9 is a perspective view showing a state in which the reattached toner seal 26 has been folded back.

In FIG. 9, the toner seal 26 welded to the toner container 25 from the area 26*a* to the area 26*b* is folded back in a fold-back portion 26*c*. Again in this state, the end portion 26*d* is in a free state. Also, again here, the toner seal take-up detecting lever 28 is in the position 28*b* in which it detects that the toner seal 26 is in its taken-up state.

Lastly, as shown in FIG. 3, the end portion 26*d* of the folded-back toner seal is attached to the toner seal take-up spool 27. As this time, the toner seal take-up detecting lever 28 is returned from the position 28*b* in which it detects that the toner seal 26 is in its taken-up state to the position 28a in which it detects that the toner seal 26 is not being pulled.

Thereafter, a toner cap closing a toner supplying opening, not shown, formed in the toner container 25 is opened to thereby refill the toner container 25 with the toner, and the toner cap is closed. Next, the toner container 25 and the developing frame 25A are connected together to thereby obtain the developing devices 9Y, 9M, 9C, 9B as a developing cartridge.

As described above, the reattachment of the toner seal can be accomplished easily, and even in a toner container provided with a toner seal automatic take-up mechanism, the reattachment of the toner seal can be accomplished easily.

While the invention has been described with reference to the structure disclosed herein, it is not confined to the details set forth and this application is intended to cover such modifications or changes as may come within the purposes of the improvements or the scope of the following claims.

What is claimed is:

1. A method of reattaching a toner seal to a toner frame, said toner frame having a developer containing portion for containing a developer therein and a developer supplying opening for supplying the developer therebrough from said developer containing portion, in order to seal said developer supplying opening, said method comprising:

(a) a detaching step of detaching an already taken-up toner seal from a take-up spool for taking up said toner seal;

(b) a sticking step of sticking said toner seal on said toner frame so as to seal said developer supplying opening;

(c) a folding-back step of folding back the toner seal from an end portion of a stuck portion of said toner seal; and (d) an attaching step of attaching a free end portion of said folded-back toner seal to said take-up spool for taking up said toner seal to unseal said developer supplying opening so that an operation of a detecting lever for detecting that a predetermined amount of said toner seal has been taken up to unseal said developer supplying opening may be restricted by said toner seal.

2. A method according to claim 1, wherein said detaching step includes a step of rotating said take-up spool in a direction opposite to a direction for taking up said toner seal to thereby detach said toner seal from said take-up spool.

3. A method according to claim 1 or 2, wherein said toner seal has a length double a length of said developer supplying opening or greater, and said sticking step includes a step of covering said developer supplying opening with a half portion of said toner seal, and a step of sticking the half portion of said toner seal on said toner frame around said developer supplying opening by heat welding.

4. A method according to claim 1, wherein said developer supplying opening extends along a lengthwise direction of said toner frame, said take-up spool is rotatably supported near one end portion of said developer supplying opening by said toner frame, said toner seal has a length double a length of said developer supplying opening or greater, said sticking step includes a step of covering said developer supplying opening with a half portion of said toner seal, and a step of sticking the half portion of said toner seal on said toner frame around said developer supplying opening, and said folding-back step includes a step of folding back said toner seal near the other end portion of said developer supplying opening.

5. A method according to claim 1 or 4, wherein said attaching step includes a step of securing said free end portion of said folded-back toner seal to said take-up spool by an adhesive agent.

6. A method according to claim 1 or 4, wherein said attaching step includes a step of clasping said free end portion of said folded-back toner seal to said take-up spool.

7. A method according to claim 1, further comprising a step of detaching a developing frame supporting a toner supplying roller from said toner frame.

8. A method according to claim 1, further comprising a step of mounting a toner seal automatic take-up mechanism on said toner frame.

9. A method of remanufacturing a developer container having a developer supplying opening formed therein, a seal member for sealing said developer supplying opening, a take-up spool for taking up said seal member to unseal said developer supplying opening, and a lever movable between a first position and a second position, said lever being in said first position when said developer supplying opening is sealed with said seal member and being in said second position when said seal member is removed from said developer supplying opening so that said developer supplying opening may be completely unsealed, said method comprising the steps of:

covering said developer supplying opening with said seal member;

attaching said seal member to said developer container around said developer supplying opening;

folding back a free portion of said seal member; and connecting a free end of said seal member to said take-up spool so that said lever may be maintained in said first position.

* * * * *

UNITED STATES PATENT AND TRADEMARK OFFICE

CERTIFICATE OF CORRECTION

PATENT NO. : 6,445,893 B2
DATED : September 3, 2002
INVENTOR(S) : Koji Hashimoto et al.

It is certified that error appears in the above-identified patent and that said Letters Patent is hereby corrected as shown below:

Column 3,
Line 51, “motor, not shown,” should read -- motor (not shown) --.

Column 4,
Line 46, “developing” should read -- developing device --.

Column 5,
Line 20, “multilayer transferred” should read -- multilayer-transferred --; and
Line 22, “comprises” should read -- is comprised --.

Column 6,
Line 10, “member, not shown,” should read -- member (not shown) --.

Column 7,
Line 3, “mechanism, not shown,” should read -- mechanism (not shown) --; and
Line 42, “an, idler” should read -- an idler --.

Column 8,
Line 52, “gear, not shown” should read -- gear (not shown) --.

Column 9,
Line 25, “abuts” should read -- abut --; and
Line 61, “mechanism, not shown,” should read -- mechanism (not shown) --.

Column 10,
Line 2, “faster,” should read -- fastener, --;
Line 13, “automatically” should read -- automatic --;
Line 59, “opening,” should read -- opening --; and
Line 60, “not shown,” should read -- (not shown) --.

UNITED STATES PATENT AND TRADEMARK OFFICE

CERTIFICATE OF CORRECTION

PATENT NO. : 6,445,893 B2
DATED : September 3, 2002
INVENTOR(S) : Koji Hashimoto et al.

It is certified that error appears in the above-identified patent and that said Letters Patent is hereby corrected as shown below:

Column 11,
Line 12, "therebrough" should read -- therethrough --.

Signed and Sealed this

First Day of April, 2003

JAMES E. ROGAN
*Director of the United States Patent and Trademark Office*